US005523198A

United States Patent [19]

Sakuma et al.

[11] Patent Number: 5,523,198

[45] Date of Patent: Jun. 4, 1996

[54] LIGHT-SENSITIVE SILVER HALIDE PHOTOGRAPHIC MATERIAL

[75] Inventors: Haruhiko Sakuma; Masaaki Taguchi, both of Hino, Japan

[73] Assignee: Konica Corporation, Tokyo, Japan

[21] Appl. No.: 352,456

[22] Filed: Dec. 9, 1994

Related U.S. Application Data

[63] Continuation of Ser. No. 148,527, Nov. 8, 1993, abandoned, which is a continuation of Ser. No. 839,944, Feb. 21, 1992, abandoned.

[30] Foreign Application Priority Data

Feb. 27, 1991 [JP] Japan ..... 3-032838

[51] Int. Cl.[6] ..... G03C 1/46; G03C 1/815

[52] U.S. Cl. ..... 430/509; 430/139; 430/966; 430/967

[58] Field of Search ..... 430/139, 509, 430/966, 967

[56] References Cited

U.S. PATENT DOCUMENTS

| | | | |
|---|---|---|---|
| H1,105 | 9/1992 | Jebo et al. | 430/139 |
| 3,923,515 | 12/1975 | van Stappen | 430/509 |
| 4,755,447 | 7/1988 | Kitts | 430/139 |
| 4,761,362 | 8/1988 | Sasaoka et al. | 430/509 |

FOREIGN PATENT DOCUMENTS

| | | |
|---|---|---|
| 384633 | 8/1990 | European Pat. Off. . |
| 440367 | 8/1991 | European Pat. Off. . |
| 1017464 | 10/1957 | Germany . |

*Primary Examiner*—Richard L. Schilling
*Attorney, Agent, or Firm*—Frishauf, Holtz, Goodman, Langer & Chick

[57] ABSTRACT

A light-sensitive silver halide photographic material is disclosed. The light-sensitive material comprises transparent support having on each side, side-A and side-B, thereof a silver halide emulsion layer and has a specified balance in speeds of the emulsion layers each provided on side-A and side-B. A specimen obtained by exposing said light-sensitive material from its one side, side-A, followed by processing has a density higher than fog density of side-B by 0.10 or more on side-B of said light-sensitive material when the amount of exposure gives a density higher than fog density of side-A by 0.2; and a density higher than fog density of side-B by 0.70 or less on side-B of said light-sensitive material when the amount of exposure gives a density higher than fog density of side-A by 1.60. The light-sensitive material suited as a film for X-ray photography and gives an image having excellent sharpness and graininess.

9 Claims, 7 Drawing Sheets

LIGHT-SENSITIVE SILVER HALIDE PHOTOGRAPHIC MATERIAL

This application is a continuation of application Ser. No. 08/148,527, filed Nov. 8, 1993, now abandoned which is a continuation of application Ser. No. 07/839,944, filed Feb. 21, 1992, now abandoned.

FIELD OF THE INVENTION

The present invention relates to a light-sensitive silver halide photographic material. More particularly, it relates to a light-sensitive material suited as a film for X-ray photography, having silver halide emulsion layers on both sides of a transparent support, and an image forming method making use of such a light-sensitive material.

BACKGROUND OF THE INVENTION

Films for X-ray photography that are utilized in medical diagnoses are commonly used in such a way that a film and a fluorescent intensifying screen are used in combination at the time a photograph is taken. This is because X-rays having passed through a front-side intensifying screen are further utilized on a back-side intensifying screen, taking account of the influence of X-rays on human bodies and for the purpose of effectively utilizing X-rays.

In recent years, under circumstances where films and intensifying screens are increasingly made to have a higher sensitivity, there is an increasing demand for a higher image quality of images for medical diagnoses. In particular, with regard to sharpness, it is strongly sought to improve performance so that the state of nidi or affected parts can be examined in more detail.

In light-sensitive silver halide X-ray photographic materials comprising a support coated with emulsions on its both sides, however, the light emitted from one intensifying screen passes through its adjoining silver halide emulsion layer, and the light thus having passed is scattered through the support to cause a phenomenon in which what is called cross-over exposure, which is a phenomenon of imagewise exposing the silver halide emulsion layer on the opposite side with the scattered light, occurs from both sides. This is a great factor that brings about a deterioration of the sharpness of an image.

A number of proposals have been hitherto made so that the cross-over exposure occurring from the both sides can be decreased and the sharpness can be improved. For example, Japanese Patent Publication Open to Public Inspection (hereinafter referred to as Japanese Patent O.P.I. Publication) No. 132945/1986, British Patent No. 821,352, etc. disclose that a dye is used in a silver halide emulsion layer or in another component layer.

With approaches from the direction of films, approaches to improvement are also made from the direction of intensifying screens. For example, Japanese Patent O.P.I. Publication No. 110538/1990 also discloses that silver halide emulsion layers having different color sensitivities are provided on the side-A and side-B, and fluorescent intensifying screens having emission spectra that are respectively in agreement with their color sensitivities are used.

These techniques for improvement, however, can not avoid the deterioration of sharpness so far as emulsions are coated on both sides and two sheets of intensifying screens are used. In particular, in oblique incidence photographing in which X-rays are made obliquely incident on the film surface in X-ray photographing systems, any disalignment between images on both sides results in a serious lowering of sharpness.

In order to make sharpness higher, it has been also attempted to provide an emulsion layer only on one side and carry out exposure only from one side. In this method, however, the sensitivity is so low that an attempt to make sensitivity higher on one side necessarily causes an increase in layer thickness of a light-sensitive emulsion layer, which brings about the disadvantages that the fixing performance, washing performance, drying speed, etc. on the one side are lowered, and images are deteriorated due to color remaining of sensitizing dye, residual silver or residual hypo. Hence, this method is not preferable.

The present inventors have ever made various studies on a method in which, in a light-sensitive silver halide photographic material having silver halide emulsion layers on both sides, the sensitivities and coating silver weights are made different between an emulsion layer on one side (side-A) and an emulsion layer on the other side (side-B) and a fluorescent intensifying screen is used only on one side so that the sharpness can be improved. As a result, they found that the surface properties of a film were not balanced between the side-A and side-B because of the side-A and side-B constituted of emulsions, silver weights, binder weights, etc. different from each other.

For example, on the side-A and side-B, a difference in the weights of binders mainly composed of gelatin in the both or a difference in silver weight caused a difference in tensile strength in the film, which brought about undesirable phenomenons such that curling occurred and an insufficient adjustment of water content in both sides caused blocking or sticking of films.

In recent years, the photographing system for X-ray films has been automated, and hence automatic transport performance of films is considered to be one of important performances. Under such circumstances, curling or sticking of films can be a fatal defect, and hence an immediate improvement has been sought.

Moreover, it is very difficult to readily distinguish in a darkroom the obverse or reverse of a film having emulsion layers on its both sides, to carry out operation, and it is usual to make a mistake in a high probability.

Thus, this is even one of the reasons why the films having differences in performances between the obverse and reverse have not been hitherto used. Accordingly, it has been pressingly needed to establish a system in which photographs can be taken without a mistake to reversely use the sides of a film, even when films having differences in performances between the obverse and reverse are used.

The present inventors have proposed a light-sensitive silver halide X-ray photographic material, and an image forming method, that can solve such technical problems, that can be a light-sensitive material with a high sensitivity and a superior sharpness, and that can obtain a high image quality even in oblique incidence photographing, can give a good film transport performance, and can obtain an image with a high sharpness where a fluorescent intensifying screen is used only on one side and exposure is carried out only from one side, as disclosed in Japanese Patent Application No. 332970/1990. In the invention disclosed therein, emulsion layers with respectively different photographic performances are provided on both sides of a transparent support, and exposure is carried out from the side of higher sensitivity, whereby an X-ray image with a high sharpness can be obtained without any inferiority in sensitivity, to conventional light-sensitive materials comprising a support provided on both sides thereof with emulsion layers having the same photographic performances. This method can dramatically improve the sharpness, but on the other hand it was found that in X-ray photography the quantum mottles tend to be conspicuous at a low-density portion, resulting in a deterioration of graininess.

In the case of photographs where importance is attached to the diagnostic performance at a low-density portion and also a portion with less difference in image density, as in chest X-ray photographs, a lowering of diagnostic performance which accompanies the deterioration of graininess tends to surpass an improvement of diagnostic performance which attributes an improvement in sharpness.

SUMMARY OF THE INVENTION

A first object of the present invention is to provide a light-sensitive silver halide photographic material having a high sensitivity and a superior sharpness and graininess.

A second object of the present invention is to provide a light-sensitive silver halide X-ray photographic material, and an image forming method, that may cause less disalignment even in oblique incidence photographing and can obtain a high image quality.

A third object of the present invention is to provide a light-sensitive silver halide X-ray photographic material that can promise a good film transport performance.

A fourth object of the present invention is to provide an image forming method making use of a light-sensitive silver halide photographic material that can obtain an image with a superior sharpness and graininess where a fluorescent intensifying screen is used only on one side and exposure is carried out only from one side.

Other objects of the present invention will become apparent from the following description.

The light-sensitive silver halide photographic material of the present invention comprises a transparent support having on each side, side-A and side-B, thereof a silver halide emulsion layer, wherein a specimen obtained by exposing said light-sensitive material from its one side, side-A, followed by developing has a density higher than fog density of side-B by 0.10 (hereinafter referred to as fog +0.10) or more on side-B of said light-sensitive material when the amount of exposure gives a density higher than fog density of side-A by 0.2 (hereinafter referred to as fog +0.2); and a density higher than fog density of side-B by 7.0 (hereinafter referred to as fog +0.70) or less on side-B of said light-sensitive material when the amount of exposure gives a density higher than fog density of side-A by 1.60 (hereinafter referred to as fog +1.60).

DETAILED DESCRIPTION OF THE INVENTION

Figure 1:
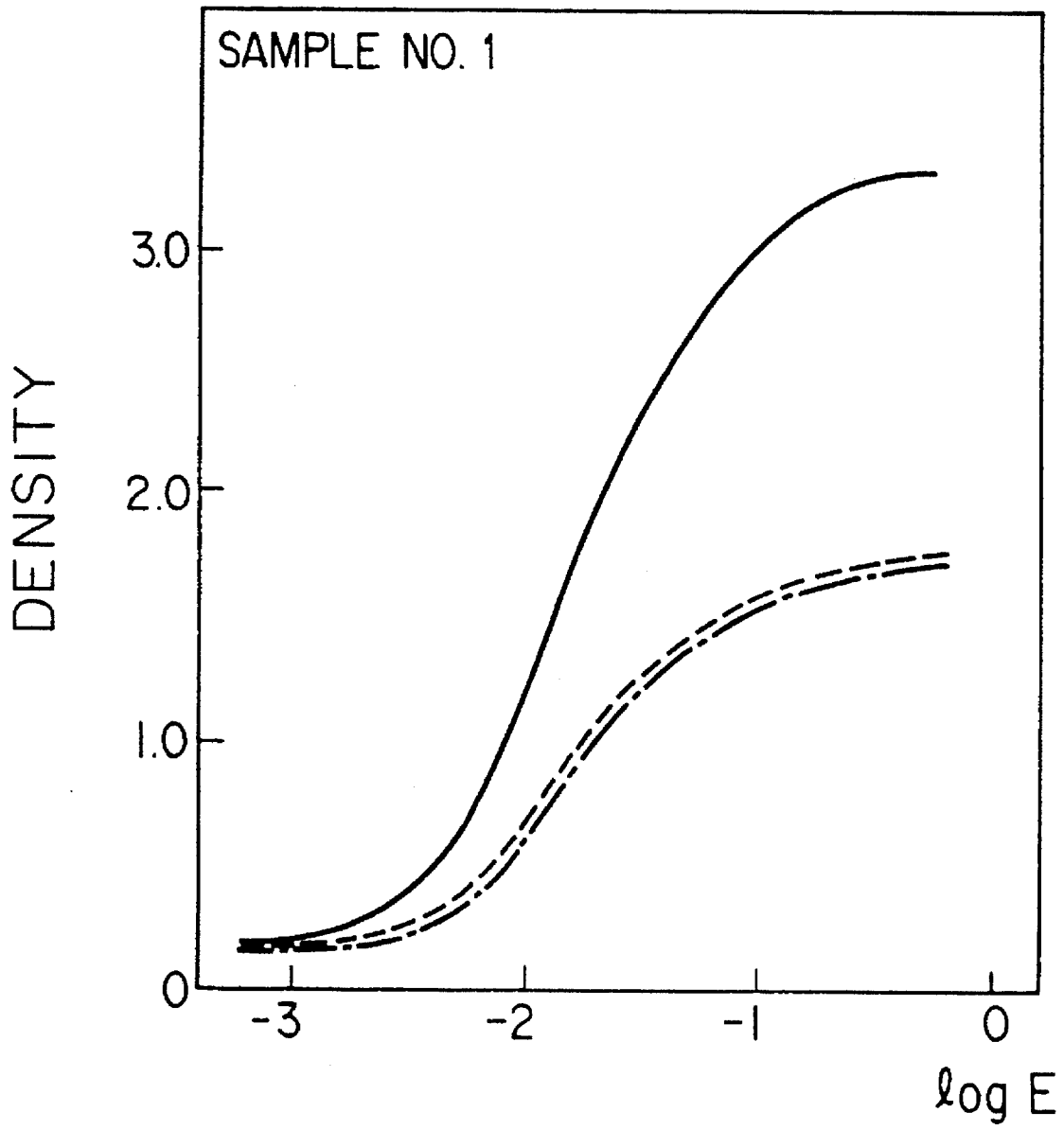
FIGS. 1 to 6 are graphs to show results of sensitometry carried out in Examples of the present invention and Comparative Examples.
Figure 2:
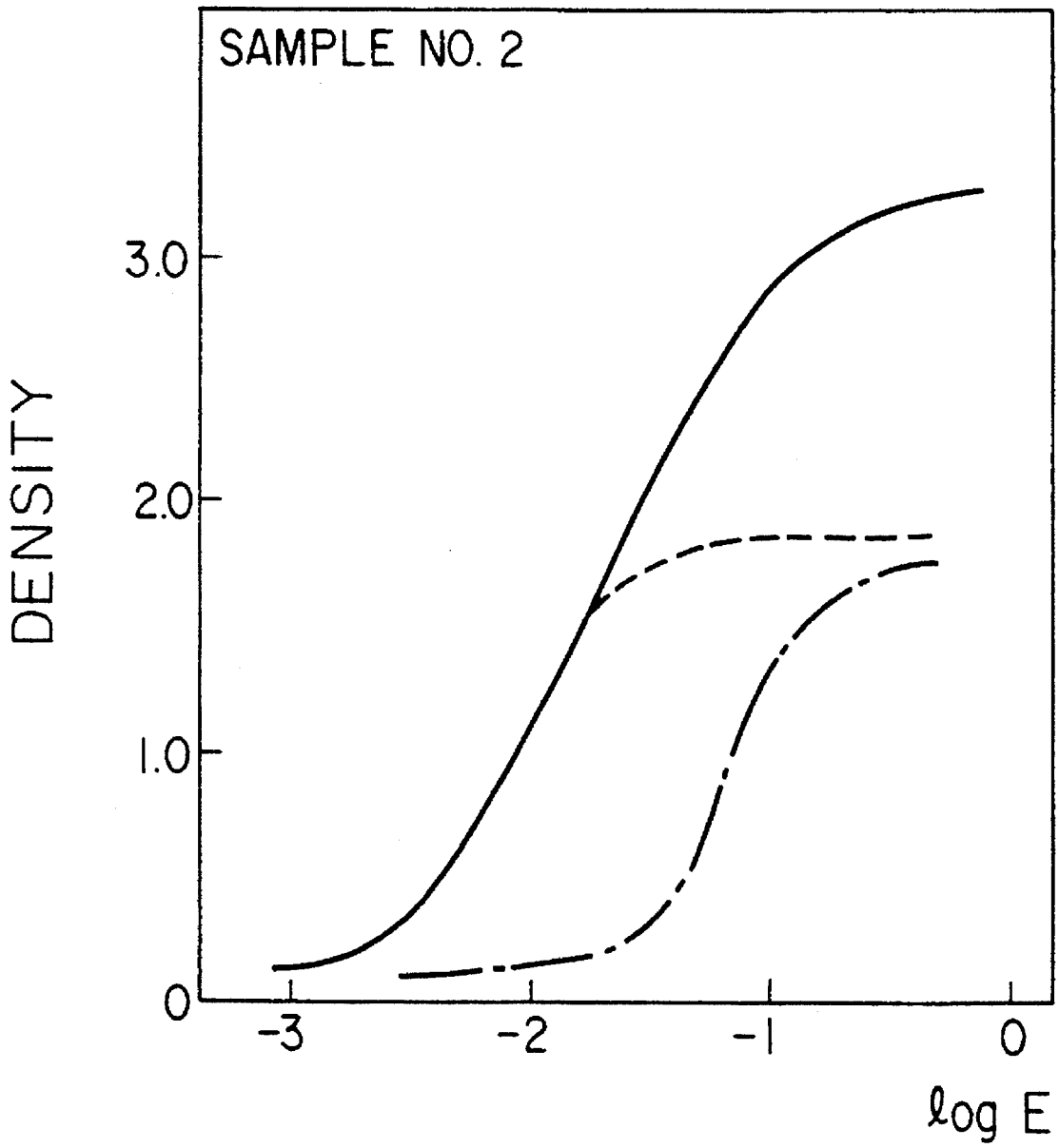
Figure 3:
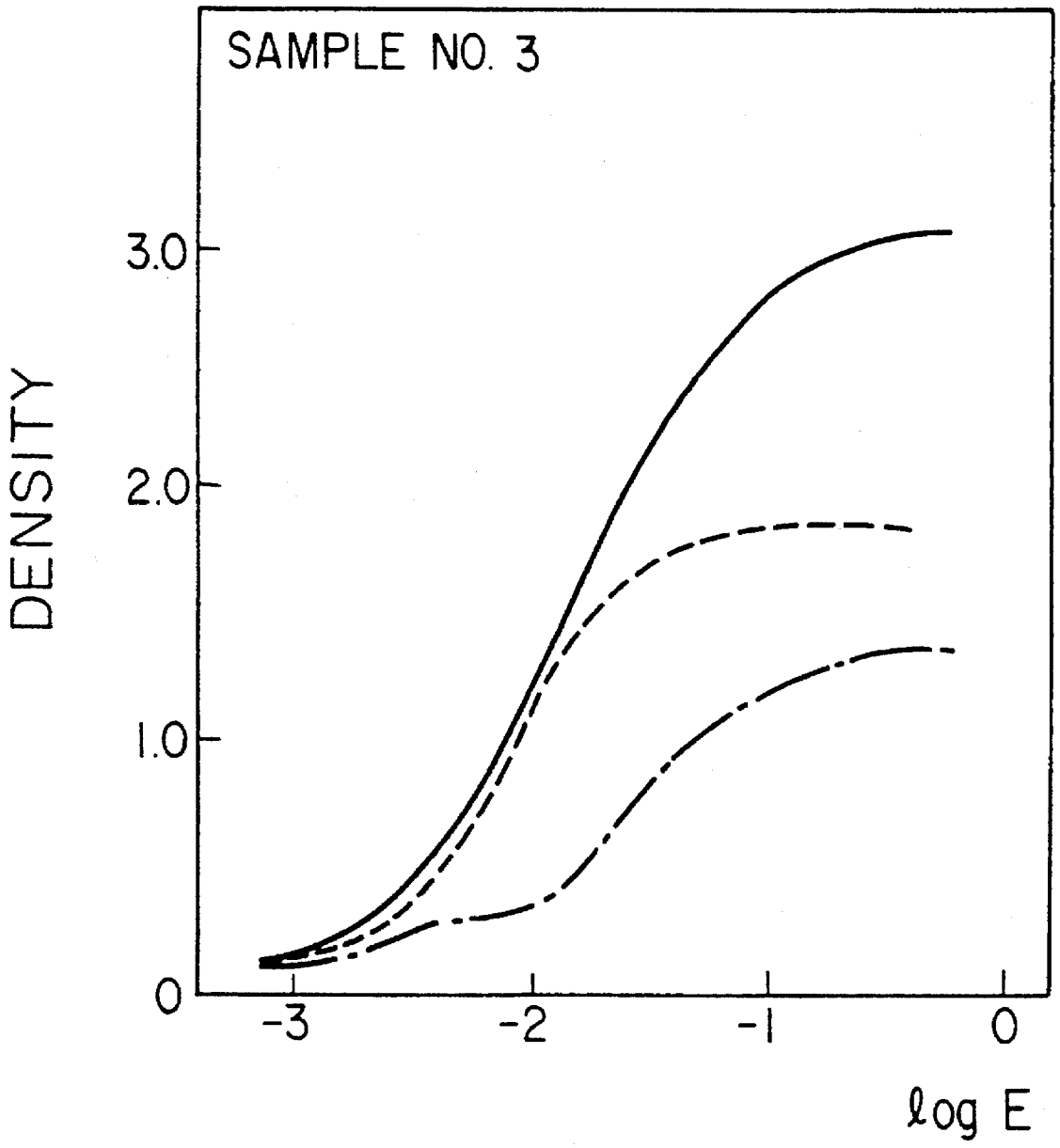
Figure 4:
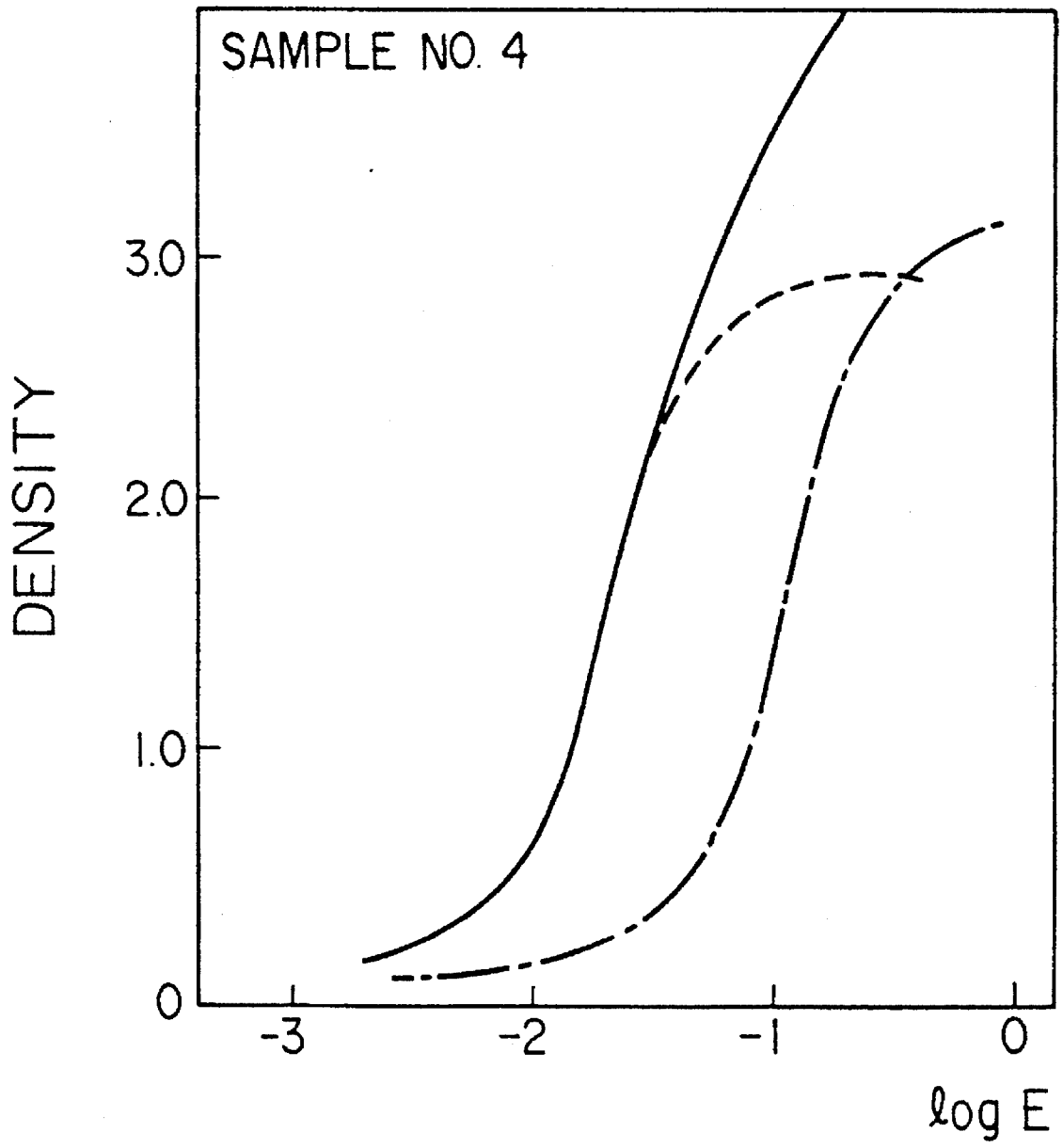
Figure 5:
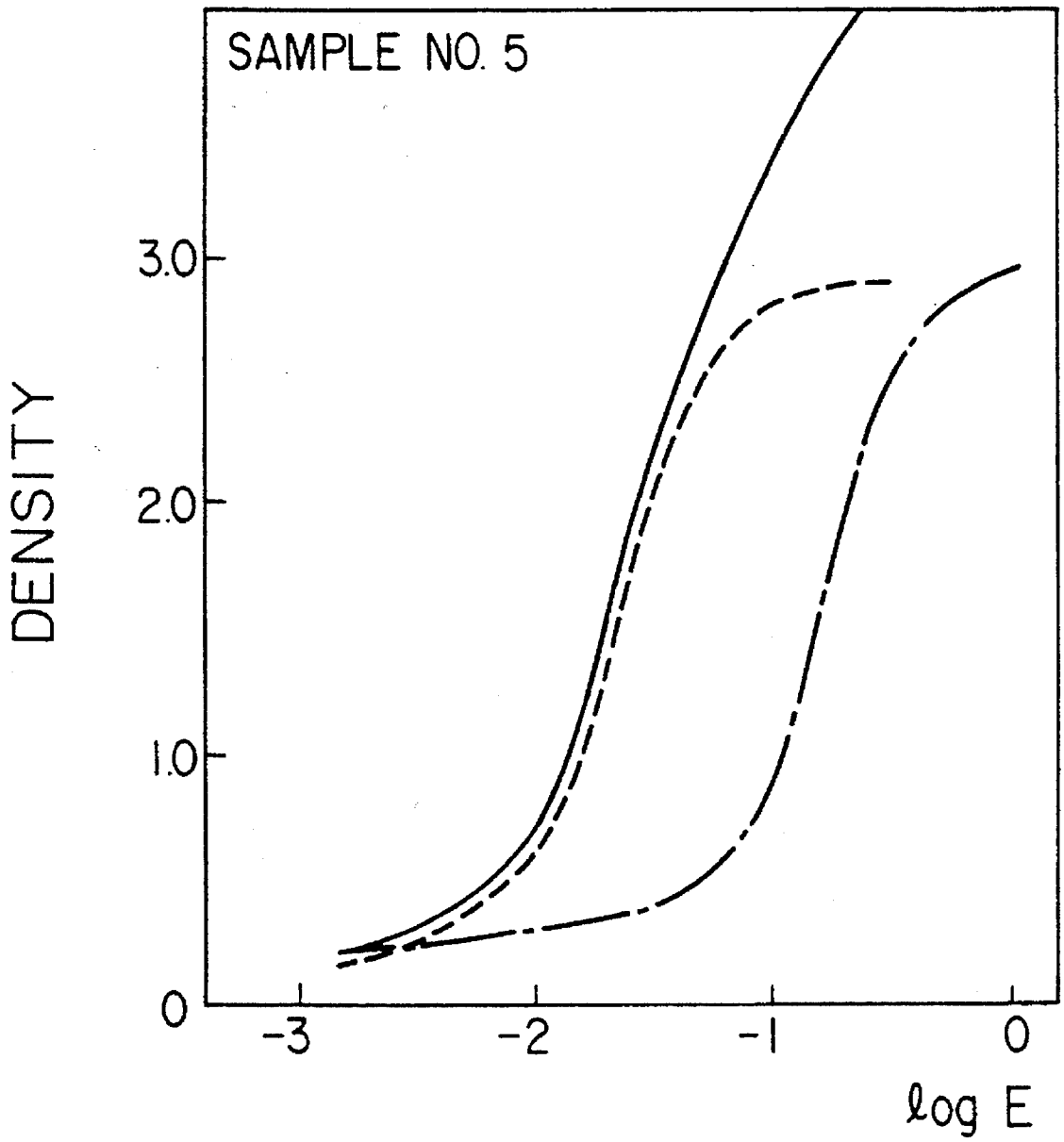
Figure 6:
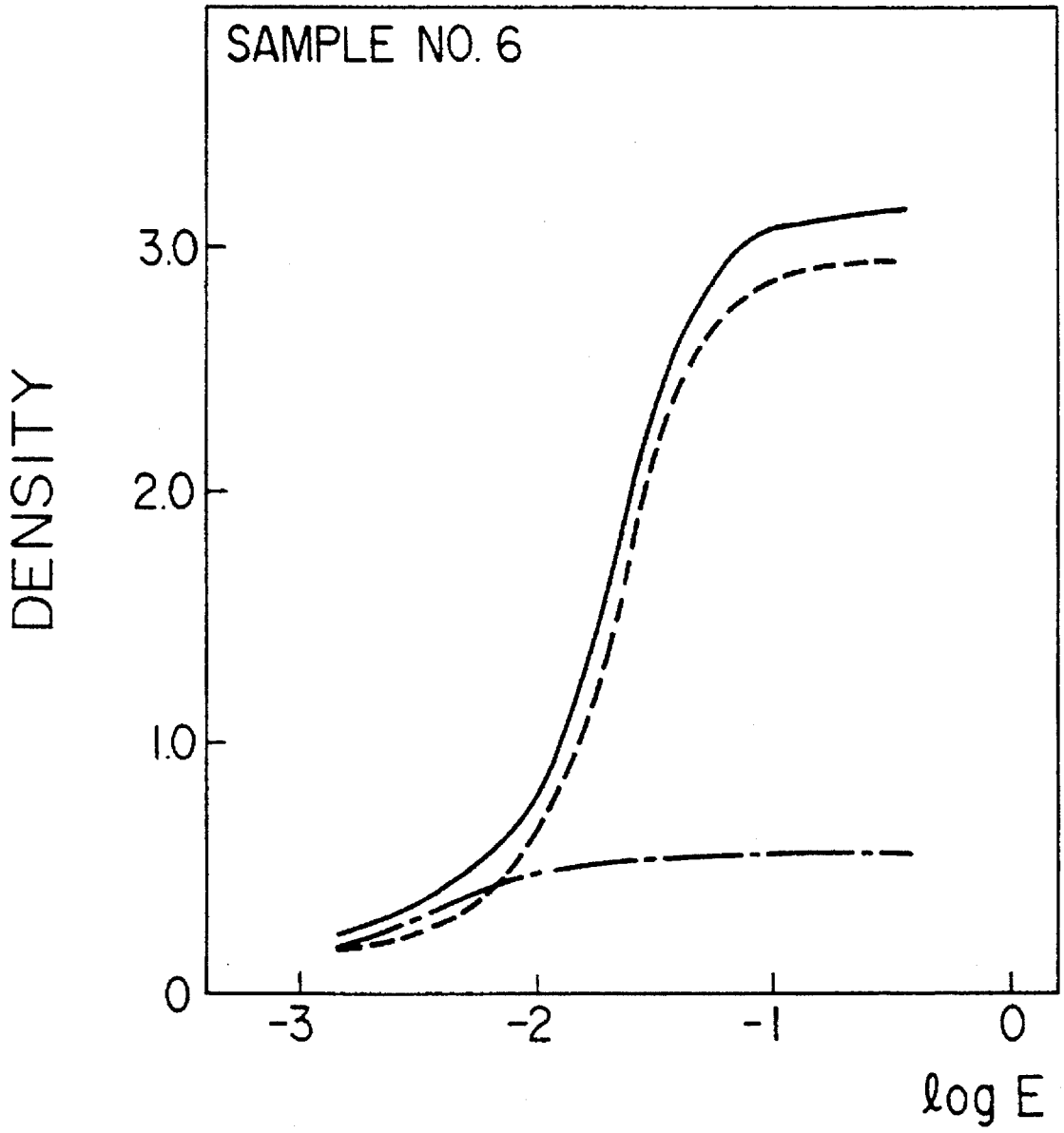

The condition in the present invention, i.e., "a specimen obtained by exposing said light-sensitive material from its one side, side-A, followed by developing has a density of not less than a density of fog density +0.10 on the side-B, when said exposure is in an amount that gives a density of fog density +0.20 to the side-A, and on the side-B has a density of not more than a density of fog density +0.70 when said exposure is in an amount that gives a density of fog density +1.60 to the side-A." (hereinafter "condition-(a)") is determined by the following measuring conditions-1

Measuring conditions-1:

| Formulation of developing solution | |
|---|---|
| Part-A (for making up to 38 lit.) | |
| Potassium hydroxide | 1,140 g |
| Potassium sulfite | 2,280 g |
| Sodium hydrogencarbonate | 266 g |
| Boric acid | 38 g |
| Diethylene glycol | 418 g |
| Ethylenediaminetetraacetic acid | 61 g |
| 5-Methylbenzotriazole | 1.9 g |
| Hydroquinone | 1,064 g |
| Made up to 9.3 lit. by adding water. | |
| Part-B (for making up to 38 lit.) | |
| Glacial acetic acid | 418 g |
| Triethylene glycol | 418 g |
| 1-Phenyl-3-pyrazolidone | 100 g |
| 5-Nitroindazole | 9.5 g |
| Made up to 1.0 lit. by adding water. | |
| Part-C (for making up to 38 lit.) | |
| Glutaldehyde (50 wt/wt %) | 304 g |
| Sodium metabisulfite | 389 g |
| Made up to 770 ml by adding water. | |
| Starter | |
| Glacial acetic acid | 230 g |
| Potassium bromide | 200 g |
| Made up to 1.5 lit. by adding water. | |

Preparation of developing solution

In 20 lit. of water kept at 18° C., the above Part-A, Part-B and Part-C are successively added with stirring, and water and an aqueous potassium hydroxide solution are finally added to make up the solution to 38 lit. with pH 10.53 at 25° C. The resulting solution is left to stand for 24 hours at 25° C., and thereafter the above starter is added thereto in an amount of 20 ml per 1 lit., to give a developing solution.

Formulation of fixing solution

| Part-A (for making up to 38 lit.) | |
|---|---|
| Ammonium thiosulfate | 6,080 g |
| Disodium ethylenediaminetetraacetate dehydrate | 0.76 g |
| Sodium sulfite | 456 g |
| Boric acid | 266 g |
| Sodium hydroxide | 190 g |
| Glacial acetic acid | 380 g |
| Made up to 9.5 lit. by adding water. | |
| Part-B (for making up to 38 lit.) | |
| Aluminum sulfate (in terms of anhydrous salt) | 570 g |
| Sulfuric acid (50 wt %) | 228 g |
| Made up to 1.9 lit. by adding water. | |

Preparation of fixing solution

In 20 lit. of water kept at 18° C., the above Part-A and Part-B are successively added with stirring, and water and acetic acid are finally added to make up the solution to 38 lit. with pH 4.20 at 25° C. The resulting solution is left to stand for 24 hours at 25° C., to give a fixing solution.

Developing conditions

Developing is carried out under conditions of a developing temperature of 35° C. and a developing time of 14.8 seconds, and fixing is carried out under conditions of a fixing temperature of 33° C. and a fixing time of 9.2 seconds.

In the above condition-(a), if the density on the side-B is more than the rod density plus 0.70 when the exposure is in an amount that gives a density higher than fog density by 1.60 to the side-A, a good graininess can be obtained, but a low sharpness may result to lower the advantage of the present invention. On the other hand, if the density on the side-B is less than the fog density plus 0.10 when the exposure is in an amount that gives a density higher than fog density by 0.20 to the side-A, a lowering in graininess may result.

The sensitivity of the emulsion layer on the side-A of the light-sensitive material according to the present invention may preferably have a sensitivity not less than 1.5 times the sensitivity of the side-B emulsion layer. The former may more preferably be from 2.0 times to 10 times the latter.

The above sensitivity is measured using a light source to the light of which the light-sensitive material of the present invention is exposed.

For example, in regular X-ray films, the sensitivity is measured using a fluorescent intensifying screen used for regular X-ray film photographing, and in orthochromatic X-ray films, measured using a fluorescent intensifying screen used for orthochromatic X-ray film photographing. In future, in the advent of any systems making utilization of other light sources, e.g., a panchromatic system and an infrared system, the sensitivity will be measured using any light source used in combination with the light-sensitive material.

The value of sensitivity can be given as a reciprocal of the amount of X-rays that is necessary to obtain an optical density of 40% of a maximum density (the support density is not included) obtained as a result of development.

The light-sensitive material of the present invention can be exposed using light with a wavelength of not less than 300 nm, followed by developing to obtain an image.

As light sources of the light with a wavelength of not less than 300 nm, it is possible to use, for example, in light-sensitive materials for laser imagers, those of 820 nm, 780 nm, etc. which are wavelengths of laser light in the case of semiconductor lasers and those of 633 nm, etc. in the case of He—Ne lasers. These can also be applied to indirect X-ray films.

Representing a low-density portion at the surface of the light-source side in an instance in which the density of the amount of information from a photograph is concentrated substantially to 2.0 or less as in black and white photographs for medical use, is very effective as a means for preventing the sharpness of photographs from being deteriorated when photographs are taken and when photographs taken are viewed.

As another object of the present invention, it is intended to make higher the sensitivity of films for a single-sided exposure system. In order to achieve a higher sensitivity, the intended sensitivity or maximum density can not be obtained unless a silver halide with a large grain size is used in a large quantity. As previously described, however, processing performances in developing, fixing, washing, drying, etc. are lowered if a layer containing a silver halide in a large quantity is provided on one side of a support.

Silver halide grains on the side that constitutes the side-A layer in the light-sensitive material of the present invention may preferably be comprised of high-speed silver halide grains having a larger average grain size than those of the side-B layer. In addition, since a density as higher as possible should be formed, the silver halide on the side-A layer side may preferably be in a larger coating weight.

The light-sensitive material that satisfies the condition-(a) can be readily obtained by, for example, using in the emulsion layer of the side-B an emulsion having a relatively high sensitivity at a low-exposure portion, specifically, fog +0.1 to 0.2, and having a low maximum density or gamma.

The total silver halide weight on the side that constitutes the side-A layer in the light-sensitive material of the present invention may preferably be not less than 1.1 times, which may more preferably be not less than 1.2 times, and not more than 5 times that of the side-B layer.

In the light-sensitive material of the present invention, the amount of light transmission of the light that passes from the side-A through the support and reaches the emulsion layer on the side-B, i.e., cross-over light, duping the single-sided exposure from the side-A may preferably be larger than that in usual double-sided light-sensitive materials for X-ray photographing. In practical photography, the amount of transmitted light of a light source used may preferably be in the range of from 12% to 75%, and more preferably from 16% to 65%.

In order to satisfy the condition relating to the above transmission, the weight of silver halide and grain size of silver halide grains in the layer constituting the side-A in the light-sensitive material of the present invention and besides the factors relating to the transmission of light from the side-A to the support may be controlled.

In the light-sensitive material of the present invention, the weight ratio of silver to gelatin on the side-A may preferably be larger than the weight ratio of silver to gelatin on the side-B. More preferably, the former is not less than 1.2 times the latter.

The light-sensitive material of the present invention may preferably contain at least one of polyhydric alcohols, in an amount of from $5.0\times10^{-5}$ to $5.0\times10^{-3}$ per gram of gelatin in a photographic component layer.

The polyhydric alcohols used in the present invention may preferably be alcohols having 2 to 12 hydroxyl groups in the molecule, having 2 to 20 carbon atoms and in which the hydroxyl groups are not conjugated with each other through conjugating chains, i.e., alcohols that can give no oxidized form. Those having a melting point of not lower than 50° C. and not higher than 300° C. are more preferable.

Examples of the polyhydric alcohols preferably usable in working the present invention are shown below. Those which are usable in the present invention are by no means limited to these examples.

| No. | Name of compound | m.p. (°C.) |
|---|---|---|
| 1 | 2,3,3,4-Tetramethyl-2,4-pentanediol | 76 |
| 2 | 2,2-Dimethyl-1,3-propanediol | 126–128 |
| 3 | 2,2-Dimethyl-1,3-pentanediol | 60–63 |
| 4 | 2,2,4-Trimethyl-1,3-pentanediol | 52 |
| 5 | 2,5-Hexanediol | 43–44 |
| 6 | 2,5-Dimethyl-2,5-hexanediol | 92–93 |
| 7 | 1,6-Hexanediol | 42 |
| 8 | 1,8-Octanediol | 60 |
| 9 | 1,9-Nonanediol | 45 |
| 10 | 1,10-Decanediol | 72–74 |
| 11 | 1,11-Undecanediol | 62–62.5 |
| 12 | 1,12-Dodecanediol | 79–79.5 |
| 13 | 1,13-Tridecanediol | 76.4–76.6 |
| 14 | 1,14-Tetradecanediol | 83–85 |
| 15 | 1,12-Octadecanediol | 66–67 |
| 16 | 1,18-Octadecanediol | 96–98 |
| 17 | cis-2,5-Dimethyl-3-hexene-2,5-diol | 69 |
| 18 | trans-2,5-Dimethyl-3-hexene-2,5-diol | 77 |
| 19 | 2-Butine-1,4-diol | 55 |
| 20 | 2,5-Dimethyl-3-hexyne-2,5-diol | 95 |
| 21 | 2,4-Hexadiyne-1,6-diol | 111–112 |

-continued

| No. | Name of compound | m.p. (°C.) |
|---|---|---|
| 22 | 2,6-Octadiyne-1,8-diol | 88.5–89.5 |
| 23 | 2-Methyl-2,3,4-butanetriol | 49 |
| 24 | 2,3,4-Hexanetriol | about 47 |
| 25 | 2,4-Dimethyl-2,3,4-pentanetriol | 89 |
| 26 | 2,4-Dimethyl-2,3,4-hexanetriol | 75 |
| 27 | Pentanemethylglycerol | 116–117 |
| 28 | 2-Methyl-2-oxymethyl-1,3-propanediol | 199 |
| 29 | 2-Isopropyl-2-oxymethyl-1,3-propenediol | 83 |
| 30 | 2,2-Dihydroxymethyl-1-butanol | 58 |
| 31 | Erythritol | 126 |
| 32 | D-threitol | 88 |
| 33 | L-threitol | 88–89 |
| 34 | rac-Threitol | 72 |
| 35 | Pentaerythritol | 260–265 |
| 36 | 1,2,3,4-Pentanetetraol | 106 |
| 37 | 2,3,4,5-Hexanetetraol | 162 |
| 38 | 2,5-Dimethyl-2,3,4,5-hexanetetraol | 153–154 |
| 39 | 1,2,5,6-Hexanetetraol | 95 |
| 40 | 1,3,4,5-Hexanetetraol | 88 |
| 41 | 1,6-(erythro-3,4)-hexanetetraol | 121–122 |
| 42 | 3-Hexene-1,2,5,6-tetraol | 80–82 |
| 43 | 3-Hexyne-1,2,5,6-tetraol | 113–114.5 |
| 44 | Adonitol | 102 |
| 45 | D-arabitol | 102 |
| 46 | L-arabitol | 102 |
| 47 | rac-Arabitol | 105 |
| 48 | Xylitol | 93–94.5 |
| 49 | Mannitol | 164 |
| 50 | Dulcitol | 188.5–189 |

All the above compounds are readily commercially available.

The light-sensitive material of the present invention may preferably have a gelatin weight per one side, of from 1.5 g/m$^2$ to 6.5 g/m$^2$, and more preferably from 2.0 g/m$^2$ to 4.5 g/m$^2$.

The present invention can also be applied to conventional one-sided emulsion type light-sensitive materials used for CRT photographing, laser printer or laser imager photographing, mammographing, etc.

The light-sensitive material of the present invention may preferably be exposed in the state the fluorescent intensifying screen is in close contact with the side-A. Particularly preferably photographs should be taken by the single-back process in which the fluorescent intensifying screen is used only on the side reverse to the side from which X-rays are incident and the side-A is brought into close contact with the fluorescent intensifying screen. This is because the present invention can achieve a very high sharpness when applied to the system of taking photographs by the single-back process on X-ray films comprising a conventional support having emulsion layers on its both sides.

Although there is little advantage in image quality, it is also possible for the light-sensitive material of the present invention to be applied to the photographing in which fluorescent intensifying screens are used on both sides of a film as in conventional X-ray films comprising a support having emulsion layers on its both sides.

Main preferred embodiments of the present invention will be described below.

The silver halide grains used on the side-A of the present invention may preferably be comprised of silver iodobromide or silver iodochlorobromide having a silver iodide content of not more than 4 mol %. They may more preferably be silver iodochlorobromide grains comprised of 0.1 to 2.5 mol % of silver iodide, not less than 97.5 mol % of silver bromide and from 0 to 2.0 mol % of silver chloride.

The silver halide on the side-A, may be in a coating weight of not more than 4.0 g/m$^2$, and preferably ranging from 1.0 to 3.5 g/m$^2$, in terms of silver weight. On the side-B, it may be in a coating weight of not more than 3.0 g/m$^2$, and preferably ranging from 0.1 to 2.5 g/m$^2$.

The fog referred to in the present invention corresponds to the sum of support density and developed silver density at a non-image portion after developing, i.e., what is called the gross fog.

The side-A of the light-sensitive material of the present invention may preferably have a maximum density of not less than 1.9, and more preferably not less than 2.0 and not more than 3.4, when exposed from the side of the side-A.

The side-B may preferably have a maximum density of not less than 0.4, and more preferably not less than 0.5 and not more than 2.5, when exposed from the side of the side-B.

The light-sensitive material of the present invention aims at forming a low-density portion and a medium-density portion (around a density of 2.0) substantially only on the side-A upon exposure from the side of the side-A, and further forming a high-density portion by exposing the side-B to light transmitted through the side-A, the support, etc. In images for medical use, a density region particularly useful for diagnosis is in the range of from the fog density to a density of 1.6 to 2.3. A high-density region of a density 2.3 or more often acts more effectively to make it easy to view any portions useful for diagnosis, of a density of from 1.6 and to 2.3 than to make a diagnosis itself based on that portion. Hence, it does little matter if the high-density portion is held by an image with a poor sharpness formed by the cross-over light coming only from side-A; rather, an image completely free from the influence of the cross-over light and also free from any lowering of sharpness even in oblique incidence photographing can be formed by forming only on the side-A an image having the density ranging from the fog density to a density of 1.6 to 2.3.

Hence, it is preferable for the light-sensitive material of the present invention not only to be a light-sensitive material merely having a difference in sensitivity between the side-A and side-B, but also to be a light-sensitive material in which, according to the purpose for which the light-sensitive material is used, substantially no image having a density that may exceed the fog +density 0.5 is formed on the side-B in a low-exposure region until an image with the density of 1.6 to 2.3 is formed on the side-A.

In general, a light-sensitive material in which the density on the side-B is the density of fog +0.20 or less when the exposure that brings the density on the side-A into the density of fog +1.60 is applied from the side of the side-A can obtain an image having a very high sharpness over the range of from a low density to a medium density, which is useful as an image for diagnosis.

Silver halide grains contained in the photographic emulsion may be any of those having grown in an entirely isotropic form such as cubes, octahedrons or tetradecahedrons, those of a polyhedral crystal form such as spheres, those comprised of twinned crystals having a plane defect, or those having a mixed or composite form of any of these. These silver halide grains may have a grain size of from as mall as 0.1 μm or less to as large as 20 μm.

The emulsions used in the light-sensitive silver halide photographic material of the present invention can be prepared by known methods. For example, they can be prepared by the methods disclosed in Emulsion Preparation and Types, Research Disclosure (RD) No. 17643, December 1978, pp.22–23, and in RD No. 18716, November 1979, p.648.

The emulsions used in the light-sensitive silver halide photographic material according to the present invention can be prepared by, for example, the method disclosed in T. H.

James, "The Theory of the Photographic Process", Fourth Edition, published by Macmillan Publishing Co., Inc. (1977), pages 38–104, and the methods disclosed in G. F. Dauffin, "Photographic Emulsion Chemistry", published by Focal Press Co. (1966), P. Glafkides, "Chemie et Physique Photographique", published by Paul Montel Co. (1967), and V. L. Zelikman et al, "Making and Coating Photographic Emulsion", published by Focal Press (1964).

More specifically, the emulsions can be prepared by selecting solution conditions of the neutral method, the acid method, the ammonia method, etc., mixing conditions of normal precipitation, reverse precipitation, double-jet precipitation, controlled double-jet precipitation, etc. and grain preparation conditions of the conversion method, the core/shell method, etc., and using any combination of these.

As a preferred embodiment of the present invention, the emulsion is a monodisperse emulsion comprising silver iodide localized in the inside of a grain.

The silver halide emulsions preferably used in the present invention may be comprised of internally iodide-rich monodisperse grains as disclosed, for example, in Japanese Patent O.P.I. Publications No. 177535/1984, No. 116347/1986, No. 132943/1986, No. 49751/1988 and No. 85845/1990. They may have a crystal habit such as a cube, a tetradecahedron, an octahedron, and intermediate forms thereof, those having (1.1.1) face and (1.0.0) face, any of which may be present as a mixed form. The monodisperse emulsion herein mentioned is defined in Japanese Patent O.P.I. Publication No. 162244/1985, and refers to an emulsion in which the variation coefficient of grain size distribution is not more than 0.20.

The variation coefficient is defined by the following equation.

Variation coefficient=Standard deviation of grain size distribution/Average grain size As to the crystal structure of the silver halide, the grain may have silver halide composition different in its inside and outside. An emulsion as a preferred embodiment is a core/shell monodisperse emulsion with a clear double-layer structure comprised of a core having a high iodide concentration and a shell having a low iodide concentration.

The core having a high iodide concentration may preferably have a silver iodide content of 20 mol % to 40 mol %, and particularly preferably 20 mol % to 30 mol %.

Such a monodisperse emulsion can be prepared by known methods, which are disclosed, for example, in *J. Phot. Sic.* 12. pp.242–251, Japanese Patent O.P.I. Publications No. 36890/1973, No. 16364/1977, No. 142329/1980 and No. 49938/1983, British Patent No. 1,413,748, and U.S. Pat. Nos. 3,574,628 and 3,655,394.

The above monodisperse emulsion may particularly preferably be an emulsion wherein grains have been grown by using seed crystals and feeding silver ions and halide ions while this seed crystals are made to serve as growth nuclei. The core/shell emulsion can be obtained by the methods disclosed in detail, for example, in British Patent No. 1,027,146, U.S. Pat. Nos. 3,505,068 and 4,444,877, and Japanese Patent O.P.I. Publication No. 14331/1985.

As another form of the grain, preferably used in the present invention, the silver halide emulsion may be comprised of tabular grains having an aspect ratio of not less than 3.

Such tabular grains are advantageous in that the efficiency of spectral sensitization can be improved and the graininess and sharpness of an image can be improved. They are disclosed, for example, in British Patent No. 2,112,157, U.S. Pat. Nos. 4,439,520, 4,433,048, 4,414,310 and 4,434,226, and Japanese Patent O.P.I. Publications No. 113927/1983, 127921/1983, No. 138342/1988, No. 284272/1988 and No. 305343/1988. The emulsion can be prepared by the methods disclosed in these publications.

The emulsion described above may be any emulsions of a surface latent image type in which a latent image is formed on the surfaces of grains, an internal latent image type in which a latent image is formed in the insides of grains, or a type in which a latent image is formed on the surfaces and insides. In these emulsions, a cadmium salt, a lead salt, a zinc salt, a thallium salt, an iridium salt or a complex salt thereof, a rhodium salt or a complex salt thereof, an iron salt or a complex salt thereof, or the like may be used at the stage where physical ripening is carried out or grains are prepared.

In order to remove soluble salts, the emulsions may be subjected to washing such as noodle washing, flocculation sedimentation or ultrafiltration. Preferred methods of washing are exemplified by a method making use of an aromatic hydrocarbon aldehyde resin having a sulfonic Group as disclosed in Japanese Patent Examined Publication No. 16086/1960 and a method making use of a high-molecular flocculating agent, such as exemplary agents G3 and G8, as disclosed in Japanese Patent O.P.I. Publication No. 158644/1988, which are particularly preferred desalting methods.

In the emulsion according to the present invention, various photographic additives can be used in the step anterior or posterior to physical ripening or chemical ripening. Known additives may include the compounds as disclosed in, for example, Research Disclosures No. 17643 (December 1978) and No. 18716 (November 1979).

The support that can be used in the light-sensitive material according to the present invention may include, for example, the supports as described in RD-17643, page 28, and RD-18715, page 647, left column.

Suitable supports may include plastic films. The surfaces of these supports may commonly be provided with a subbing layer or subjected to corona discharging or ultraviolet irradiation so that the adhesion of coating layers can be improved. Then the support thus treated can be coated on both sides thereof with the emulsion according to the present invention.

EXAMPLES

Example 1

(1) Preparation of monodisperse grains:

Using, as nuclei, highly monodispersed emulsion grains of silver iodobromide having an average grain size of 0.2 μm, containing 2.0 mol % of silver iodide, having the form of a cube and having a coefficient of variation, which measures monodispersity, of 0.15, silver iodobromide grains containing 30 mol % of silver iodide were grown under conditions of pH 9.8 and pAg 7.8. Thereafter, potassium bromide and silver nitrate were added in equimolar amounts under conditions of pH 8.2 and pAg 9.1. Emulsions comprising four kinds of monodisperse emulsion grains of tetradecahedrons with an average grain size of 0.375 μm, 0.64 μm, 1.22 μm and 1.95 μm and having coefficients of variation of 0.17, 0.16, 0.16 and 0.17, respectively, were thus prepared so as to give silver iodobromide grains having an average silver iodide content of 2.2 mol %. These were designated as emulsions (1)-1, (1)-2, (1)-3 and (1)-4, respectively.

The emulsions thus obtained were each subjected to desalting using a conventional flocculation process to remove excessive salts. More specifically, the desalting was carried out, while maintaining the emulsion at 40° C., by adding a formalin condensate of sodium naphthalene-sulfonate and an aqueous solution of magnesium sulfate to effect flocculation, followed by removal of the supernatent liquid.

(2) Preparation of tabular grain emulsions:

To 5.5 lit. of an aqueous 1.5% gelatin solution containing 0.17 mol of potassium bromide, potassium bromide and silver nitrate corresponding to 2.1 mol and 2.0 mol, respectively, in the form of aqueous solutions were added by double-jet precipitation over a period of 3 minutes with stirring at 80° C. and pH 5.7. The pBr was maintained to 0.8. (0.53% of the whole silver nitrate used was consumed).

The addition of the aqueous potassium bromide solution was stopped, and the addition of the aqueous silver nitrate solution was continued for 4.6 minutes. (8.6% of the whole silver nitrate used was consumed). Subsequently, the aqueous potassium bromide solution and aqueous silver nitrate solution were simultaneously added for 12 minutes. During this addition, the pBr was maintained to 1.15, and the addition flow rate was accelerated so as for the rate at the time of completion to become 2.3 times that at the time of initiation. (43.6% of the whole silver nitrate used was consumed).

The addition of the aqueous potassium bromide solution was stopped, and the aqueous silver nitrate solution was added for 1 minute. (4.7% of the whole silver nitrate used was consumed).

An aqueous 2.1 mol potassium bromide solution containing 0.55 mol of potassium iodide was added over a period of 12.0 minutes together with the aqueous silver nitrate solution. During this addition, the pBr was maintained to 1.8, and the flow rate was accelerated so as for the rate at the time of completion to become 1.6 times that at the time of initiation. (35.9% of the whole silver nitrate used was consumed). To the resulting emulsion, 1.5 g/mol.Ag of sodium thiocyanate was added, which was then maintained for 25 minutes. Potassium iodide corresponding to 0.60 mol and the silver nitrate were added by double-jet precipitation at equal flow rates for about 5 minutes until the pBr reached 3.0. (6.6% of the whole silver nitrate used was consumed). The whole silver nitrate consumed was in an amount of about 11 mol. Emulsion (2) was thus prepared, containing tabular silver iodobromide grains with an average grain diameter of 1.91 μm and an aspect ratio of about 11:1.

In the resulting grains, 80% or more of the whole projection areas of the silver iodobromide grains were held by tabular grains.

Preparation of Samples, Processing, and Evaluation

To the silver halide emulsions (1)-1, (1)-2, (1)-3, (1)-4 and (2) each thus obtained, pure water was added so as to give a volume of 500 ml per mol of silver, and thereafter the mixture was maintained at 55° C. Then, spectral sensitizers A and B set out later were added in a weight ratio of 200:1 so as to give their total weight of 820 mg for the emulsion (1)-1, 600 mg for (1)-2, 360 mg for (1)-3, 500 mg for (1)-4 and 640 mg for the emulsion (2), all per mol of silver halide. After 10 minutes, ammonium thiocyanate was added in an amount of $4\times10^{-3}$ mol for the emulsion (1)-1, $2\times10^{-3}$ mol for (1)-2, $1\times10^{-3}$ mol for (1)-3, $1.6\times10^{-3}$ mol for (1)-4 and $3\times10^{-3}$ mol for the emulsion (2), all per mol of silver, and chloroauric acid and sodium thiosulfate were further added in appropriate amounts to initiate chemical ripening. This chemical ripening was carried out under conditions of a pH of 6.20 and a silver electrode potential of 47 mV.

At 15 minutes before completion of the chemical ripening, i.e. 70 minutes after initiation of the chemical ripening, silver iodide grains having an average grain size of 0.07 μm were added in an amount of 250 mg per mol of silver. After 5 minutes, 10% (wt/vol) of acetic acid was added to lower the pH to 5.6, and this pH value was maintained for 5 minutes. Thereafter, an aqueous 0.5% (wt/vol) potassium hydroxide solution was added to restore the pH to 6.15, followed by addition of 4-hydroxy-6-methyl-1,3,3a,7-tetrazaindene. The chemical ripening was thus completed.

The resulting emulsions (1)-1, (1)-2, (1)-3, (1)-4 and (2) were mixed in the combination as shown in Table 1, followed by addition of the emulsion additives as set out later. Emulsion coating solutions were thus prepared.

These photographic emulsion coating solutions were so prepared that they had a pH of 6.52 and a silver electrode potential of 68 mV (35° C.) after their preparation, using sodium carbonate and potassium bromide.

Using these emulsion coating solutions, samples were prepared in the following way: Using two sets of slide hopper type coaters, a support was coated thereon with the emulsion coating solution and the protective coating solution set out later by both-side simultaneous coating at a coating speed of 80 m per minute. The photographic, emulsion layers were so formed as to have a gelatin weight of 1.98 g/m$^2$ on both the high-speed emulsion side and the low-speed emulsion layer side, and have a silver halide weight as shown in Table 1 as a value in terms of silver.

The coating solution for a protective layer was also prepared using the additives as set out later, so as to have a gelatin coating weight of 1.15 m/g$^2$, followed by drying in 2 minutes and 20 seconds. The samples were thus obtained.

The emulsions and the protective layer coating solution had been kept at 35° C. As the support, a 175 μm thick polyethylene terephthalate film base used for X-ray films and tinted in blue with a density of 0.15 was used, which had been coated with a subbing solution comprising a water-based copolymer dispersion obtained by diluting to a concentration of 10% by weight a copolymer comprising three kinds of monomers of 50% by weight of glycidyl dimethacrylate, 10% by weight of methyl acrylate and 40% by weight of butyl methacrylate.

The spectral sensitizers used for the preparation of samples were as follows:

Spectral sensitizer A

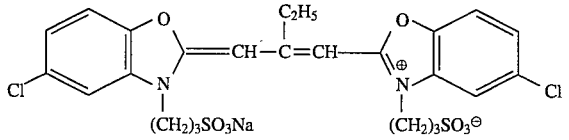

Spectral sensitizer B

-continued

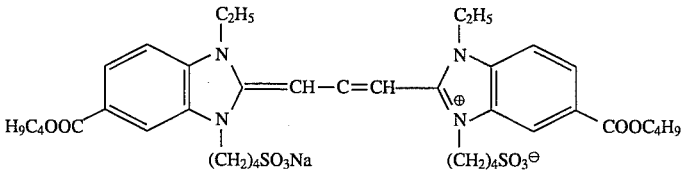

The additives used in the emulsion coating solutions were as follows. The amounts of the additives were each indicated as weight per mol of silver halide.

| | |
|---|---|
| 1,1-Dimethylol-1-bromo-1-nitromethane | 70 mg |
| 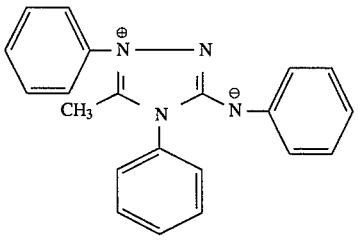 | 150 mg |
| t-Butylcatechol | 400 mg |
| Polyvinylpyrrolidone (molecular weight: 10,000) | 1.0 g |
| Styrene/maleic anhydride copolymer | 2.5 g |
| Nitrophenyl-triphenylphosphonium chloride | 50 mg |
| Ammonium 1,3-dihydroxybenzene-4-sulfonate | 4 g |
| Sodium 2-mercaptobenzimidazole-5-sulfonate | 1.5 mg |
| Styrene/butadiene copolymer particles (particle diameter: 0.06 μm) | 3.0 g |
| 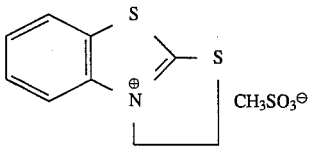 | 70 mg |
| 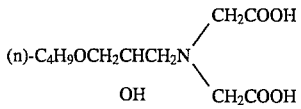 | 1 g |
| 2,2-Dihydroxymethyl-1-butanol | 15 g |
| 1-Phenyl-5-mercaptotetrazole | 15 mg |
| Dye-emulsified dispersion* | 1.2 g |

The additives used in the protective layer coating solution were as follows. The amounts of the additives are each indicated as weight per liter of coating solution.

| | |
|---|---|
| Lime-treated inert gelatin | 68 g |
| Acid-treated gelatin | 2 g |
| Sodium-i-amyl-n-decylsulfosuccinate (a coating aid) | 0.3 g |
| Polymethyl methacrylate, a matting agent with an area average particle diameter of 3.5 μm | 1.1 g |
| Dimethylsiloxane (dispersed using dodecylbenzene-sulfonate) (particle diameter: 0.10 μm) | 0.5 g |
| Silicon dioxide particles, a matting agent with an area average particle diameter of 1.2 μm | 0.5 g |
| LUDOX AM (available from Du Pont Co.) (colloidal silica) | 30 g |
| Aqueous 2% solution of sodium 2,4-dichloro-6-hydroxy-1,3,5-triazine (a hardening agent) | 10 ml |
| Aqueous 40% glyoxal solution (a hardening agent) | 1.5 ml |
| $(CH_2{=}CHSO_2CH_2)_2O$ (a hardening agent) | 500 mg |

-continued

| | |
|---|---|
| 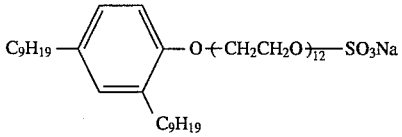 | 1.0 g |
| 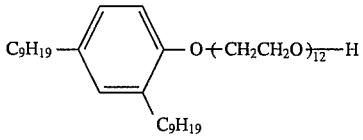 | 0.4 g |
| $NaO_3S-CH(CH_2COOCH_2(C_2F_4)_3H)COOCH_2(C_2F_4)_3H$ | 0.5 g |
| $C_{12}H_{25}CONH(CH_2CH_2O)_5H$ | 2.0 g |

*The dye-emulsified dispersion was prepared in the following way.

Dye:

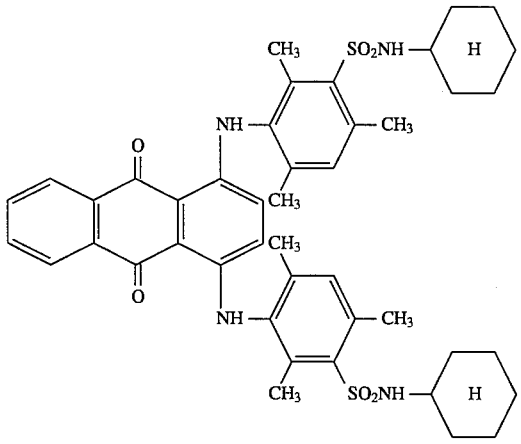

The above dye was weighed in an amount of 10 kg, and was added at 55° C. to a solvent comprised of 28 lit. of tricresyl phosphate and 85 lit. of ethyl acetate. The resulting solution is called an oil-based solution. Meanwhile, 270 ml of aqueous 9.3% gelatin solution in which 1.35 kg of anionic surface active agent (the following AS) was dissolved at 45° C. was prepared. This solution is called a water-based solution.

AS:

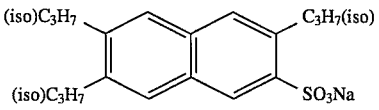

The above oil-based solution and water-based solution were put in a dispersion vessel, and were dispersed while controlling the liquid temperature to be kept at 40° C. To the resulting dispersion, the following additives and water were added to make up the dispersion to 240 kg, followed by cooling to effect solidification.

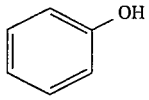

Aqueous 2.5% solution 16 lit.

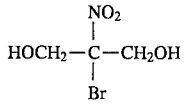

8 g

The dispersion thus obtained had an area average particle diameter within the range of from 0.12 to 0.14 μm.

Measurement of Sensitivity

In the measurement of the sensitivities of the samples obtained, photographs were taken by the single-back method (a method in which the intensifying screen was arranged only on the side of the film farther from the X-ray source) making use of only a back screen of fluorescent intensifying screen SRO-250 (available from Konica Corporation). The SRO-250 intensifying screen is a fluorescent intensifying screen incorporating, as the active fluorescent material or phosphor, $Gd_2O_2$:Tb, to produce the emission spectrum shown in FIG. 7. Those on which photographs were taken in the state the fluorescent intensifying screen was brought into contact with the high-speed emulsion side (side-A) and those on which photographs were taken in the state the fluorescent intensifying screen was brought into contact with the low-speed emulsion side (side-B) were both processed to give sample 1-I and sample 1-II.

In this photographing, a black coating with a high light absorption was applied on the side of the cassette on which no intensifying screen was present.

The photographing was carried out under irradiation of X-rays at a tube voltage of 90 kVP at 20 mA for 0.05 second. For preparing a sensitometric curve, the irradiation was carried out with variation of the distance of the sample from the X-ray tube, and the sensitivity, maximum density and gamma of each sample were obtained.

The photographic processing was carried out under the following conditions.

Processing conditions

Automatic processor.

Using SRX-501, manufactured by Konica Corporation, the samples were processed in the processing mode of 45 seconds. The processing was carried out at a developing bath temperature of 35° C. and a fixing bath temperature of 33° C. Washing water was kept at 18° C. and fed at a rate of 4 lit per minute. Drying was carried out at a temperature of 45° C. The environmental conditions of the room in which the automatic processor was placed were 25° C. and 60% RH.

Formulation of developing solution

The same as the formulation of developing solution in the measuring conditions-1 previously described.

Preparation of developing solution

In a replenishing solution stock tank, 20 lit. of water kept at 18° C. was put, to which the Part-A, Part-B and Part-C previously described were successively added with stirring, and water and an aqueous potassium hydroxide solution were finally added to make up the solution to 38 lit. with pH 10.53 at 25° C. This developing replenishing solution was left to stand for 24 hours at 25° C., and thereafter the starter was added thereto in an amount of 20 ml per 1 lit. Then a developing tank of the automatic processor manufactured by Konica Corporation was filled with the solution. Here, the developing solution had a pH of 10.26 at 25° C.

The developing replenishing solution was supplied in an amount of 365 ml per 1 $m^2$ of the sample of the present invention.

Formulation of fixing solution

The same as the formulation of fixing solution in the measuring conditions-1 previously described.

Preparation of fixing solution

In a replenishing solution stock tank, 20 lit. of water kept at 18° C. was put, to which the above Part-A and Part-B were successively added with stirring, and water and an aqueous potassium hydroxide solution were finally added to make up the solution to 38 lit. with pH 4.20 at 25° C. This fixing replenishing solution was left to stand for 24 hours at 25° C., and thereafter a fixing tank of the automatic processor manufactured by Konica Corporation was filled with the solution. The fixing replenishing solution was supplied in an amount of 640 ml per 1 $m^2$ of the sample of the present invention.

The light-sensitive layer on the side-B was removed from the sample 1-I by the use of a protein-lyric enzyme to determine the sensitivity of side-A, $S_A$. Similarly the light-sensitive layer on the side-A was removed from the sample 1-II to determine the sensitivity of side-B, $S_B$. The light-sensitive layer on the side-A was removed from the sample 1-I in the same manner to determine $S_B'$, from which a value of $S_B'/S_B$ was determined (Table 1). From this value $S_B'/S_B$, the amount of light transmission from the high-speed emulsion side, side-$S_A$, to the low-speed emulsion side, side-$S_B$, can be determined.

The value of sensitivity was determined as a reciprocal of the amount of X-rays that was necessary to obtain a density corresponding to a value obtained by multiplying by 0.4 the value obtained by subtracting the support density from the maximum density, and further adding thereto the support density. In Table 2, the value is indicated as a relative sensitivity with respect to the sensitivity of sample No. 1 that is assumed as 100.

Sample No. 1 is a sample having the same emulsion component layers as conventional double-sided X-ray films and to which usual exposure has been applied using respectively on its both sides a fluorescent intensifying screen for front side and a fluorescent intensifying screen for back side (SRO-250).

The system gamma in Table 2 is indicated as a reciprocal of a doubled difference between logarithms of reciprocals of the amounts of X-rays that give a density 0.80 and a density 1.30.

Results of the above sensitometry are shown in FIGS. 1 to 6. In the drawings, solid lines each show the characteristic curve based on a total density of the image formed on both sides of the sample, and dotted lines and chain lines each show the characteristic curve based on the image formed only on the high-speed emulsion side or low-speed emulsion side, respectively.

With regard to samples having been coated and dried, measurement and evaluation were made on the following.

Measurement of sharpness

To evaluate the image quality of each sample No. 1 to 6, sharpness was evaluated on practical picture samples.

Photographs of a Funk test chart SMS5853 (trade name; available from Konica Medical Corporation) were taken at a tube voltage of 90 kVP using the fluorescent intensifying screen SRO250 only on the high-speed emulsion side which is farther from the X-ray tube, according to the single-back method. Processing was carried out in the same manner as in the sensitometry described above i.e., processing using the same automatic processor, processing solutions, processing temperature and processing time.

To evaluate the sharpness, the Funk test chart was used, which was processed at the same tube voltage, using the same intensifying screens and under the same conditions as the practical photographing.

As to the amount of exposure, each sample was exposed so as to be 0.8±0.02 in average density of the light and shade produced by the Funk test chart.

Evaluation of sharpness

A: Using a hand magnifier, recognizable up to 10 LP/mm.

B: Using a hand magnifier, recognizable up to 8 LP/mm.

C: Using a hand magnifier, recognizable up to 6 LP/mm.

D: Using a hand magnifier, recognizable up to 5 LP/mm.

E: Using a hand magnifier, recognizable up to 4 LP/mm.

In the foregoing, A indicates the best, and E, the worst. Results obtained are shown in Table 2 below.

In the table, $S_B$ represents sensitivity of the side-B light-sensitive layer. $S_B'$ represents apparent sensitivity obtained from the image on the side-B, obtained by removing the side-A light-sensitive layer from the sample 1-I previously described.

Therefore $S_B'/S_B$ corresponds to the ratio of the amount of the light that passes from the side-A through the support and reaches the side-B to the amount of the light incident on the side-A.

Measurement of graininess

By the same X-ray photographing as in the case when the above sensitometric characteristics are obtained, samples were subjected to uniform exposure so as for their densities to come to 0.60 each, and then to photographic processing. The graininess of each sample thus processed was visually evaluated.

Evaluation of graininess

A: Graininess is so good that granular structures are little seen even when observed at a distance of 30 cm.

B: Granular structures are conspicuous when observed at a distance of 30 cm, but not conspicuous at 60 cm.

C: Granular structures are conspicuous when observed at a distance of 60 cm, but not conspicuous at 1 m.

D: Granular structures are conspicuous when observed at a distance of 1 m, but not conspicuous at 1.5 m.

E: Granular structures are conspicuous even when observed at a distance of 1.5 m.

The system sensitivity and the system gamma were determined in the following way.

Sample No. 1 was subjected to conventional double-sided X-ray photographing wherein the intensifying screens SRO-250 were respectively brought into close contact with both sides of the sample. Samples No. 2 to 6 were subjected to photographing by the single-back method wherein the intensifying screen SRO-280 was provided only on the reverse side of an X-ray source and brought into close contact with the high-speed emulsion side (side-$S_A$) of the film.

In the photographing, irradiation was made at a tube voltage of 90 kVP at 20 mA for 0.05 second. For preparation of sensitometric curve, the amount of exposure of the X-ray was varied with variation of the distance between the sample and the X-ray tube, and the system sensitivity and gamma were determined.

The sensitivity corresponded to the density obtained by magnifying the maximum density by 0.4. The system gamma was determined in the foregoing manner.

Results obtained in the above are shown in Table 2.

TABLE 1

| Sample No. | Composition of emulsions in high-speed layer | Composition of emulsions in high speed layer | Silver coating weight: High-speed layer (mg/m²) | Silver coating weight: Low-speed layer (mg/m² | Exposure | $S_B^1/S_B$ |
|---|---|---|---|---|---|---|
| 1 | (1)-1 30%<br>(1)-2 50%<br>(1)-3 20% | (1)-1 30%<br>(1)-2 50%<br>(1)-3 20% | 2.15 | 2.15 | Both sides* | 0.33 |
| 2 | (1)-3 60%<br>(1)-2 40% | (1)-1 50%<br>(1)-2 50% | 3.50 | 1.51 | Single back* | 0.32 |
| 3 | (1)-3 60%<br>(1)-2 40% | (1)-1 70%<br>(1)-4 30% | 3.50 | 1.60 | Single back* | 0.32 |
| 4 | (1)-3 25%<br>(2) 75% | (2) 100% | 2.30 | 2.00 | Single back* | 0.19 |
| 5 | (1)-3 25%<br>(2) 75% | (1)-4 40%<br>(2) 60% | 2.30 | 2.00 | Single back* | 0.19 |
| 6 | (1)-3 25%<br>(2) 75% | (1)-4 100% | 2.30 | 1.00 | Single back* | 0.19 |

*Both sides: Usual exposure using fluorescent intensifying screens on both sides of the film.
*Single back: Exposure using a fluorescent intensifying screen located on one side of the film on the side farther from an X-ray source.

TABLE 2-1

| Sample No. | High-speed emulsion layer Relative sensitivity | Side A Maximum density | Low-speed emulsion layer Relative sensitivity | Side B Maximum density | System sensitivity | System gamma | Remarks |
|---|---|---|---|---|---|---|---|
| 1 | 100 | 1.72 | 100 | 1.72 | 100 | 2.9 | X |
| 2 | 240 | 1.91 | 68 | 1.65 | 101 | 2.8 | X |
| 3 | 240 | 1.91 | 64 | 1.42 | 113 | 2.5 | Y |
| 4 | 145 | 2.93 | 79 | 3.11 | 84 | 3.3 | X |
| 5 | 145 | 2.93 | 79 | 3.00 | 90 | 3.2 | Y |
| 6 | 145 | 2.93 | 805 | 0.38 | 100 | 2.9 | Y |

X: Comparative Example
Y: Present Invention

TABLE 2-2

| Sample No. | (1) | (2) | Sharpness | Graininess | Remarks |
|---|---|---|---|---|---|
| 1 | — | — | E | B | X |
| 2 | 0.17 | 0.00 | A | D | X |
| 3 | 0.30 | 0.22 | B | A | Y |
| 4 | 0.05 | 0.03 | A | D | X |
| 5 | 0.38 | 0.14 | B | A | Y |
| 6 | 0.32 | 0.22 | B | A | Y |

(1): Density of low-speed side (− fog value) when density of high-speed side is fog + 1.60
(2): Density of low-speed side (− fog value) when density of high-speed side is fog + 0.20
X: Comparative Example
Y: Present Invention As shown in Table 2, the samples according to the present invention had a high sharpness and also a good graininess. Using the samples of the present invention (No. 3, No. 5 and No. 6) and the comparative samples (No. 2 and No. 4), chest phantoms were photographed at a tube voltage of 120 kVP by the single-back method, and using sample No. 1, photographed by double-sided photographing. As a result, the samples according to the present invention showed 8 satisfactory representation even at a low-density portion and a very high sharpness at medium- and high-density portions, thus giving good photographs.

Figure 7:
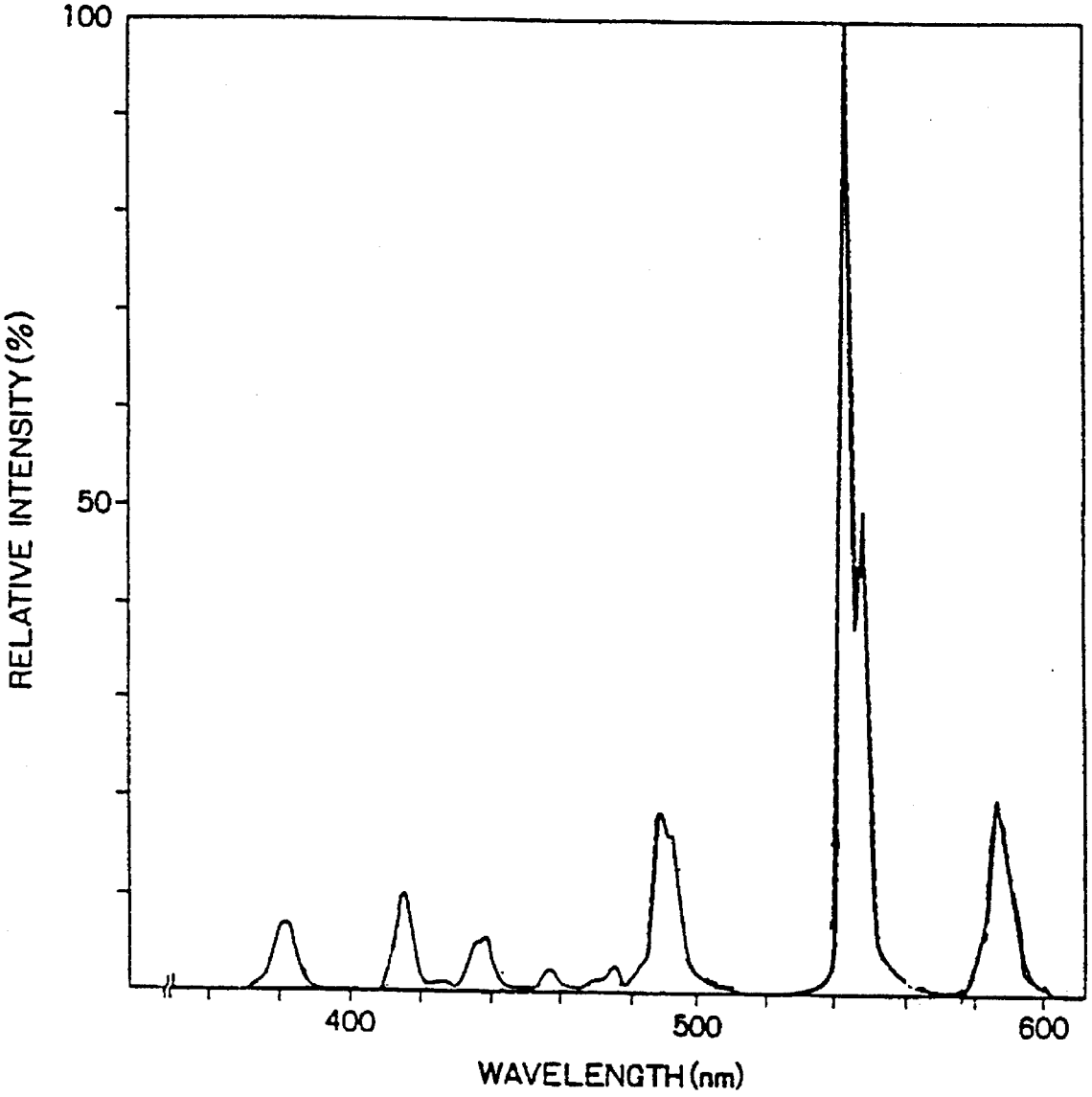
FIG. 7 shows the emission spectrum of an SRO-250 (Trade Name of KONICA CORPORATION) fluorescent intensifying screen.

What is claimed is:

1. A light-sensitive silver halide photographic material comprising a transparent support having on each side thereof, side-A and side-B, a silver halide emulsion layer, wherein a specimen obtained by exposing said light-sensitive material from its one side, side-A, using an X-ray source with a fluorescent intensifying screen having an emission spectrum as shown in FIG. 7, followed by processing under processing conditions set forth below, has a density higher than fog density of side-B by 0.10 or more on side-B of said light-sensitive material when the amount of exposure gives a density higher than fog density of side-A by 0.2; and a density higher than fog density of side-B by 0.70 or less on side-B of said light-sensitive material when the amount of exposure gives a density higher than fog density of side-A by 1.60.

Processing Conditions

Developing solution

| | |
|---|---|
| Part-A (for making up to 38 lit.) | |
| Potassium hydroxide | 1,140 g |
| Potassium sulfite | 2,280 g |
| Sodium hydrogencarbonate | 266 g |
| Boric acid | 38 g |
| Diethylene glycol | 418 g |
| Ethylenediaminetetraacetic acid | 61 g |
| 5-Methylbenzotriazole | 1.9 g |
| Hydroquinone | 1,064 g |
| Made up to 9.3 lit. by adding water | |
| Part-B (for making up to 38 lit.) | |
| Glacial acetic acid | 418 g |
| Triethylene glycol | 418 g |
| 1-Phenyl-3-pyrazolidone | 100 g |
| 5-Nitroindazole | 9.5 g |
| Made up to 1.0 lit. by adding water | |
| Part-C (for making up to 38 lit.) | |
| Glutaldehyde (50 wt/wt %) | 304 g |
| Sodium metabisulfite | 389 g |
| Made up to 770 ml by adding water | |
| Starter | |
| Glacial acetic acid | 230 g |
| Potassium bromide | 200 g |
| Made up to 1.5 lit. by adding water | |

Preparation of developing solution in 20 lit. of water kept at 18° C., the above Part-A, Part-B and Part-C are successively added with stirring, and water and an aqueous potassium hydroxide solution are finally added to make up the solution to 38 lit. with pH 10.53 at 25° C. the resulting solution is left to stand for 24 hours at 25° C., and thereafter the above starter is added thereto in an amount of 20 ml per 1 lit., to give a developing solution;

Fixing solution

| | |
|---|---|
| Part-A (for making up to 38 lit.) | |
| Ammonium thiosulfate | 6,080 g |
| Disodiumethylenediaminetetraacetate dihydrate | 0.76 g |
| Sodium sulfite | 456 g |
| Boric acid | 266 g |
| Sodium hydroxide | 190 g |
| Glacial acetic acid | 380 g |
| Made up to 9.5 lit. by adding water | |
| Part-B (for making up to 38 lit.) | |

-continued

| | |
|---|---|
| Aluminum sulfate (in terms of anhydrous salt) | 570 g |
| Sulfuric acid (50 wt %) | 228 g |
| Made up to 1.9 lit. by adding water | |

Preparation of fixing solution in 20 lit. of water kept at 18° C., the above Part-A and Part-B are successively added with stirring, and water and acetic acid are finally added to make up the solution to 38 lit. with pH 4.20 at 25° C., the resulting solution is left to stand for 24 hours at 25° C., to give a fixing solution;

Developing conditions developing is carried out under conditions of a developing temperature of 35° C. and a developing time of 14.8 seconds, and fixing is carried out under conditions of a fixing temperature of 33° C. and a fixing time of 9.2 seconds.

2. The light-sensitive material of claim 1, wherein the amount of light reached to the emulsion layer of side-B is 12% to 75% of the amount of light incident on the emulsion layer of side-A when exposure is applied from the side of side-A with light of wavelength not shorter than 300 nm.

3. The light-sensitive material of claim 2, wherein the amount of light reached to the emulsion layer of side-B is 16% to 65% of the amount of light incident on the emulsion layer of side-A when exposure is applied from the side of side-A with light of wavelength not shorter than 300 nm.

4. The light-sensitive material of claim 1, wherein a speed of the emulsion layer provided on said-A is higher 1.5 times or more than that of the emulsion layer provided on side-B.

5. The light-sensitive material of claim 4, wherein a speed of the emulsion layer provided on said-A is higher 2.0 to 10 times than that of the emulsion layer provided on side-B.

6. The light-sensitive material of claim 1, wherein the amount of silver coated on side-A is larger than the amount of silver coated on side-B of the light-sensitive material.

7. The light-sensitive material of claim 1, wherein the maximum density of the maximum density of an image formed in the emulsion layer of side-A is not less than 2.0 and the maximum density of an image formed in the emulsion layer of side-B is less than 2.0.

8. The light-sensitive material of claim 1, wherein the emulsion layer coated on side-A of the light-sensitive material contains tabular silver halide grains having an aspect ratio of not less than 3.0 in an amount of not less than 60% of the total silver halide grains contained in said emulsion layer in the ratio of projection area of the grains.

9. The light-sensitive material of claim 1, wherein the emulsion layer coated on side-A of the light-sensitive material contains monodispersed regular crystal silver halide grains in an amount of not less than 60% of the total silver halide grains contained in said emulsion layer in the ratio of projection area of the grains.

* * * * *